US005875901A

United States Patent [19]

Morrow et al.

[11] Patent Number: 5,875,901

[45] Date of Patent: Mar. 2, 1999

[54] PRODUCT DISPLAY

[75] Inventors: Lester W. Morrow, Chanhassen; Charles E. Lee, Woodbury, both of Minn.

[73] Assignee: Gage In-Store Marketing, Minneapolis, Minn.

[21] Appl. No.: 789,775

[22] Filed: Jan. 28, 1997

[51] Int. Cl.[6] ..... A47F 1/04

[52] U.S. Cl. ..... 211/59.1; 40/649; 211/103; 211/113

[58] Field of Search ..... 211/59.1, 57.1, 211/103, 113, 117, 119, 86; 40/649, 611

[56] References Cited

U.S. PATENT DOCUMENTS

| | | | |
|---|---|---|---|
| 3,027,012 | 3/1962 | Talmadge | 211/113 X |
| 4,034,865 | 7/1977 | Batts et al. | 211/118 |
| 4,573,590 | 3/1986 | Ellis | 211/86 |
| 4,767,012 | 8/1988 | Simmons | 211/89 |
| 5,086,935 | 2/1992 | Gallagher | 211/59.1 X |
| 5,284,259 | 2/1994 | Conway et al. | 211/73 |
| 5,305,898 | 4/1994 | Merl | 211/59.1 X |
| 5,339,967 | 8/1994 | Valiulis | 211/57.1 |
| 5,386,916 | 2/1995 | Valiulis | 211/113 |
| 5,465,516 | 11/1995 | Stabile | 40/649 |
| 5,509,541 | 4/1996 | Merl | 211/103 |
| 5,524,774 | 6/1996 | Cullen | 211/113 |
| 5,526,941 | 6/1996 | Ford | 211/103 X |
| 5,641,081 | 6/1997 | Merl | 211/103 |

*Primary Examiner*—Peter M. Cuomo
*Assistant Examiner*—Stephen Vu
*Attorney, Agent, or Firm*—Michael Best & Friedrich LLP

[57] ABSTRACT

A product display including a base unit having a header portion and a strip portion, the strip portion having a plurality of sets of apertures along its length and at least one product hanger having a pair of ends which are removably positionable in the apertures to secure the product hanger to the strip portion, the product hanger including a support member adapted to support products to be displayed.

20 Claims, 2 Drawing Sheets

PRODUCT DISPLAY

FIELD OF THE INVENTION

The invention relates to product displays, and more particularly, to product displays for displaying products conveniently in a variety of positions.

BACKGROUND OF THE INVENTION

Product displays for displaying products vertically in relation to one another are often termed strip merchandisers. Typically, strip merchandisers include an elongate strip with provision for supporting product at a fixed interval along the elongate length of the strip. Such strip merchandisers suffer from the drawback that since the product securing mechanisms are at fixed intervals, the same strip merchandiser is not adjustable to accommodate a variety of different sized products. Such strip merchandisers can only accommodate those products that fit into dimensions dictated by the fixed intervals. Further, strip merchandisers also utilize product securing mechanisms that only accommodate one product per securing means, therefore limiting the quantity of products that the strip merchandiser can display.

SUMMARY OF THE INVENTION

The invention provides a base unit having a header portion and an elongate strip portion. The header portion is adapted to be secured to a support. The strip portion includes an elongate central wall and a pair of guide members. The guide members have therein a plurality of sets of apertures relatively spaced along their length. Each aperture in one guide member are aligned with another aperture in the other guide member. The invention also provides for at least one product hanger having a pair of hanger ends. The hanger ends are removably positionable in one of the sets of aligned apertures to secure the product hanger to the strip portion. The product hanger includes a support member adapted to support the products to be displayed.

It is one object of the present invention to provide an improved product display capable of supporting and displaying product in a variety of locations.

It is another object of the present invention to provide a product display that displays products vertically.

It is another object of the present invention to provide a product display that includes a base unit and at least one product hanger removably positionable along the length of the base unit.

It is another object of the present invention to provide a product display that is adjustable to accommodate various sized products.

It is another object of the present invention to provide a product display that includes a display area for product indicia.

It is another object of the present invention to provide a product display that utilizes product hangers that include resilient legs that are easily deformable to removably position the hangers along the length of the display.

Other features and advantages of the invention will become apparent to those of ordinary skill in the art upon review of the following detailed description, claims, and drawings.

Figure 2:
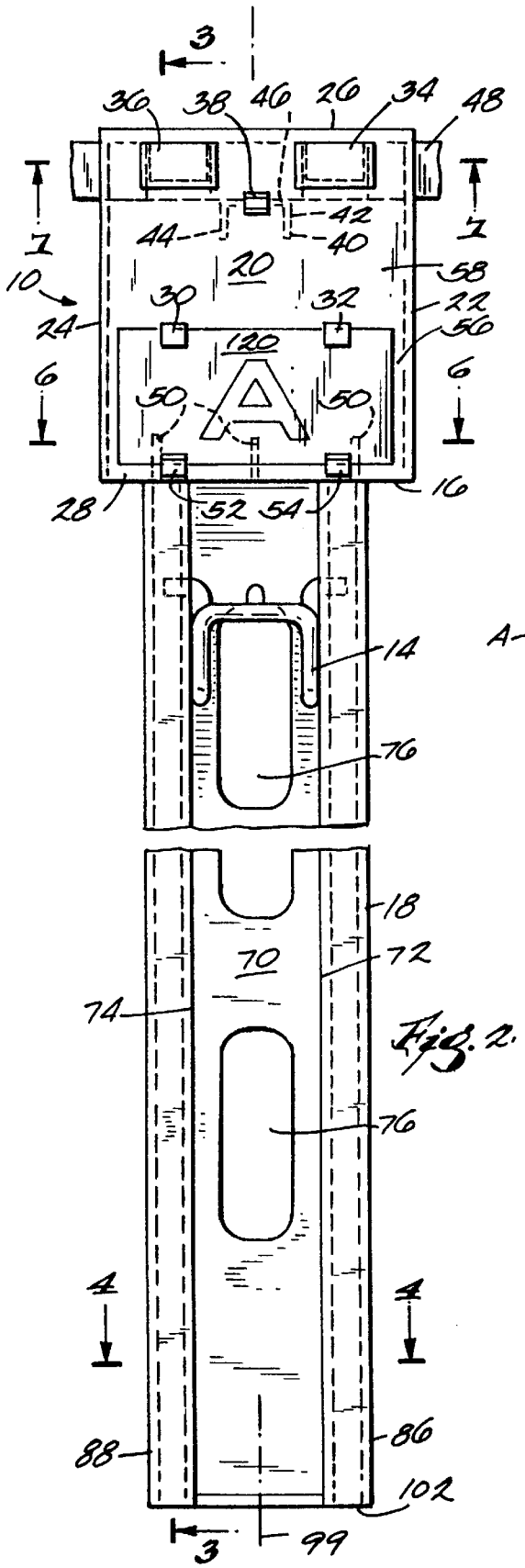
FIG. 2 is a front view of a base unit of the product display.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Figure 1:
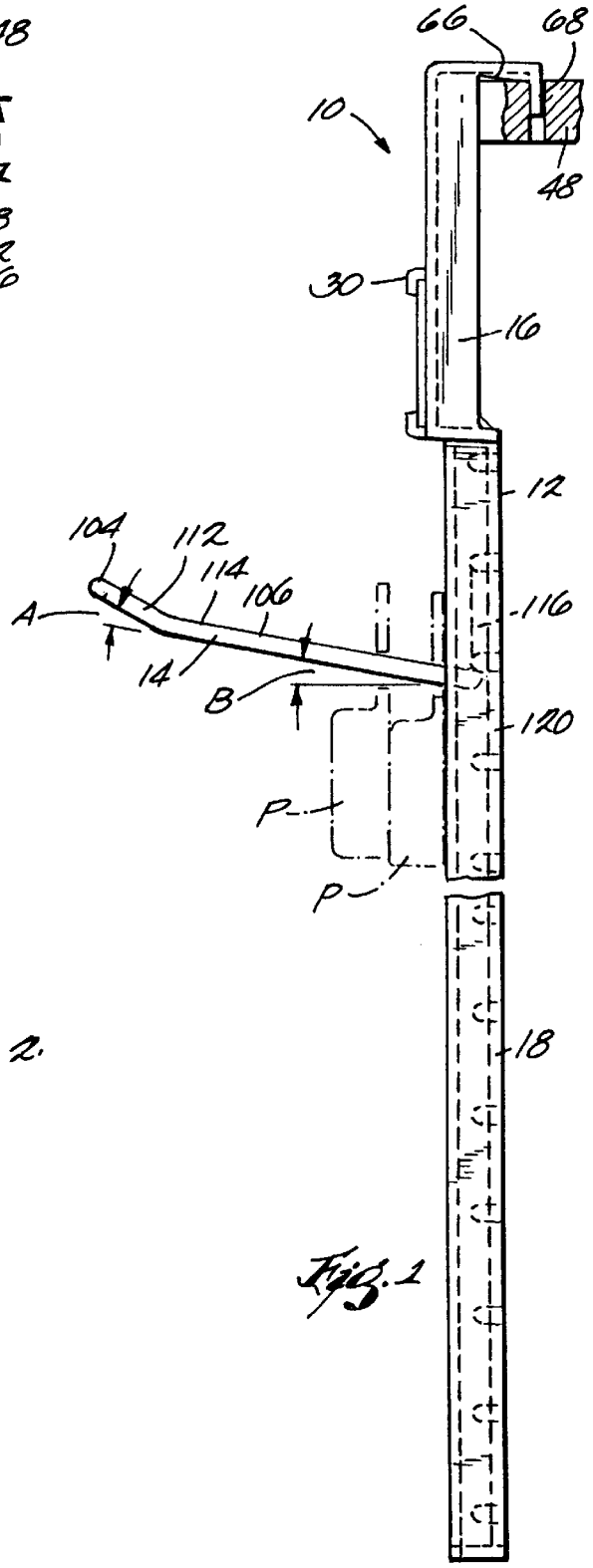
FIG. 1 is a side view of the product display embodying the invention secured to a support.

Referring now to the drawings, there is shown in FIG. 1 a product display 10 embodying the invention. The product display 10 includes two components in combination, a base unit 12 and at least one product hanger 14.

Specifically, the base unit 12 includes a header portion 16 and a strip portion 18. Preferably, the header and strip portions 16 and 18, respectively, are integral and fabricated by injection molding of a plastic material such as styrene.

The header portion 16 can be of various shapes but is preferably rectangular. As best shown in FIG. 2, the header portion 16 includes a top wall 20, a pair of side walls 22 and 24 and a pair of end walls 26 and 28. The side walls 22 and 24 and the end walls 26 and 28 depend from the periphery of the top wall 20. A pair of aligned tabs 30 and 32 extend outwardly from the top wall 20. The tabs 30 and 32 are preferably L-shaped such that the tabs 30 and 32 open toward the strip portion 18. The top wall 20 further includes a pair of aligned apertures 34 and 36 and a third aperture 38. A spacer member 40 depends from the top wall 20 and is aligned with the aperture 38. The spacer member 40 is generally U-shaped in cross-section and includes a leg 42, a leg 44 and a web 46 therebetween. The legs 42 and 44 are preferably triangular. The spacer member 40 operates to distance the strip portion 18 from a support 48.

Continuing to refer to FIG. 2, the header portion 16 includes spaced gussets 50 that depend from the top wall 20 and the end wall 28. Preferably, the gussets 50 are generally triangular (FIG. 1). The gussets 50 provide structural support to the header portion 16. The end wall 28 further includes a pair of outwardly extending tabs 52 and 54 that align with the tabs 30 and 32, respectively. The tabs 52 and 54 are preferably L-shaped and open toward the end wall 26. The tabs 30 and 32 and the tabs 52 and 54 cooperate to define a first display area 56 on the top wall 20. The remainder of the top wall 20 defines a second display area 58.

Figure 5:
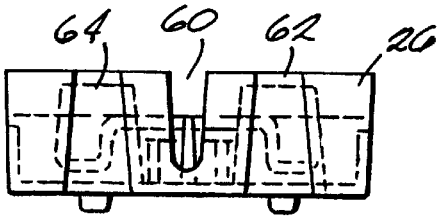
FIG. 5 is an end view of the base unit.
Figure 3:
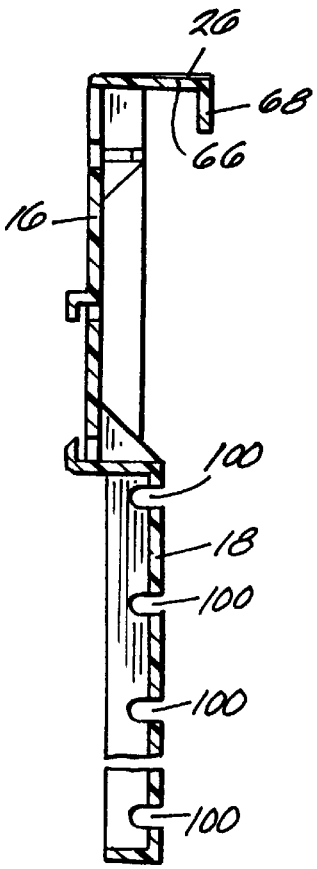
FIG. 3 is a view taken along line 3—3 of FIG. 2.
Figure 7:
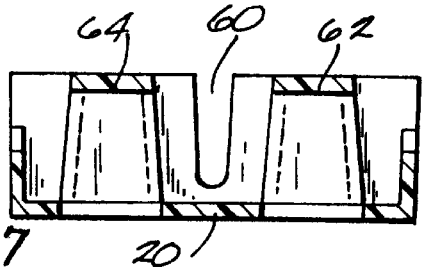
FIG. 7 is a view taken along line 7—7 of FIG. 2.

Turning now to FIGS. 5 and 7, the end wall 26 has therein a central generally U-shaped slot 60. The end wall 26 further includes a pair of spaced hooks 62 and 64 with one hook on each side of the slot. As best shown in FIG. 3, each hook 62 and 64 is generally L-shaped and comprised of a first leg 66 integral with and generally offset from the end wall 26 toward the strip portion 18. A second leg 68 extends generally perpendicularly from the leg 66 towards the strip portion 18. The hooks 62 and 64 are aligned with the apertures 34 and 36 respectively (FIG. 2).

Figure 6:
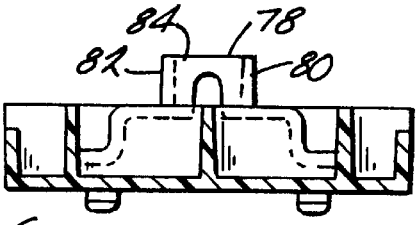
FIG. 6 is a view taken along line 6—6 of FIG. 2.

Referring back to FIG. 2, the strip portion 18 is generally elongate and preferably depends from the end wall 28 of the header portion 16. The strip portion 18 includes a central wall 70 having a first side edge 72 and a second side edge 74. The central wall 70 has therein a plurality of central elliptical openings 76. As shown in FIG. 6, a second spacer member 78 depends from the central wall 70. The spacer member 78 is generally U-shaped in cross-section and includes a leg 80, a leg 82 and a web 84 therebetween. Each of the legs 80 and 82 are triangular (FIG. 1). The spacer member 78 operates to distance the strip portion 18 from the support 48.

Figure 4:
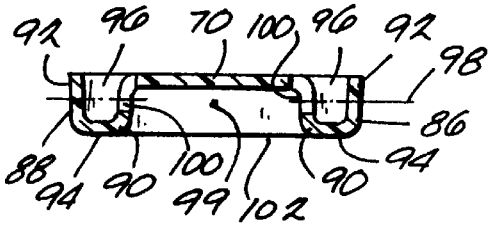
FIG. 4 is a view taken along line 4—4 of FIG. 2.

Referring back to FIG. 2, an elongate guide member 86 and 88 abuts the side edge 72 and 74, respectively, of the central wall 70. The guide members 86 and 88 are preferably identical, parallel and extend the length of the central wall 70. As best shown in FIG. 4, preferably, the guide members 86 and 88 are U-shaped in cross-section defined by a first wall 90, a second wall 92 and a web 94 therebetween. The wall 90 and the wall 92 of each guide member 86 and 88 are generally parallel. The web 94 and the central wall 70 are generally parallel. The wall 90, the wall 92 and the web 94 of each guide member 86 and 88 defines a channel 96.

Referring now to FIGS. 3 and 4, the wall 90 of each guide member 86 and 88 has therein a plurality of apertures 100 along its length. The apertures 100 are preferably U-shaped in cross-section. Each aperture 100 in the guide member 86 is aligned with an apertures 100 in the guide member 88 along an axis 98 that is transverse to an axis 99 of the strip portion 18 (FIG. 4).

As best shown in FIGS. 2 and 4, the strip portion 18 terminates in a stop member such as the end wall 102. The end wall 102 extends generally perpendicularly from the central wall 70 in a direction toward the guide members 86 and 88.

Figure 8:
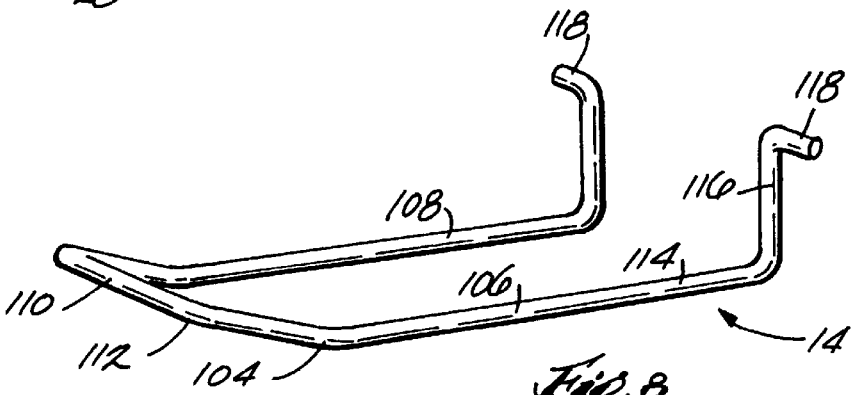
FIG. 8 is a perspective view of a product hanger.

Referring now to FIGS. 1 and 8, the product hangers 14 are illustrated. Each product hanger 14 is preferably fabricated of wire such as 10 gauge wire with a zinc or preplate finish shaped into the configuration shown in FIGS. 1 and 8. Preferably, the configuration includes a support member such as loop portion 104 to support the products P to be displayed, although other configurations can be employed.

Specifically, the loop portion 104 of each product hanger 14 includes a pair of resilient legs 106 and 108 and an end portion 110 between and connecting the legs 106 and 108. Each leg 106 and 108 preferably includes a first portion 112, a second portion 114 and a third portion 116. The first portion 112 is at an angle A of preferably 8 degrees with respect to the second portion 114. The second portion 114 is at an angle B preferably on the order of 28 degrees with respect to the horizontal when positioned on the base unit 12. The third portion 116 is generally perpendicular to the second portion 114. Each third portion 116 terminates in a hanger end 118. Each hanger end 118 is generally perpendicular to its respective third portion 116. The hanger ends 118 are axially aligned.

The product display 10 is operable as follows. The base unit 12 is secured to the support 48 by hanging the header portion 16 over the support 48 such as a shelf or the like. The hooks 62 and 64 of the header portion 16 are adapted to be inserted in apertures in the support 48 (as illustrated) or to surround a portion of the support 48 so that the base unit 12 hangs vertically from the support 48. Product indicia such as UPC codes, nutritional information, price, advertising or the like can be placed in either of the display areas 56 or 58 such as card 120 shown in display area 56. The tabs 30, 32, 52 and 54 of the display area 56 can be utilized to hold the card 120 in place.

Product hangers 14 are then positioned along the strip portion 18 by selecting a pair of aligned apertures 100 along the length of the base unit 12. The resilient legs 106 and 108 of the product hanger 14 are then deformed slightly toward one another such that the hanger ends 118 can be positioned into the apertures 100. The deformation is then ceased such that the hanger ends 118 extend into the respective channel 96 of the guide members 86 and 88 and the third portion 116 of each leg 106 and 108 abuts the central wall 70 of the strip portion 18. A single product or a plurality of products P can then be hung from the product hanger 14. Similarly, other products hangers can be positioned along the base unit 12 at desired intervals through the selection of the desired apertures 100 into which the hanger ends 118 of the hangers 14 are positioned.

With the plurality of aligned apertures 100 along the length of the base unit 12, there are a great number of varying product arrangements that can be achieved using the product display 10.

If it is necessary to remove or reposition a product hanger 14, the legs 106 and 108 of the hanger 14 are deformed inwardly toward one another and the hanger ends 118 are freed from the apertures 100.

Although the product hangers 14 are configured as illustrated, it should be noted that the hangers 14 can have varying configurations and still have ends that are insertable into desired apertures in the base unit.

We claim:

1. A product display comprising:

a base unit having a header portion and an elongate strip portion, said header portion including a top wall, a pair of tabs extending from said top wall and a pair of oppositely arranged end walls and said strip portion being attached to one of said end walls and extending from said header portion with said top wall positioned above and in alignment with said strip portion, said header portion adapted to be secured to a support surface, said strip portion including a central wall having a pair of side edges and a pair of guide members, each having a length, with said guide members abutting said side edges, wherein said guide members having therein a plurality of apertures along said length; and at least one product hanger having a pair of hanger ends, wherein said hanger ends are removably positionable in said apertures to secure said product hanger to said strip portion, said product hanger includes a support member adapted to support products to be displayed.

2. A product display as set forth in claim 1 wherein said header portion includes a hook adapted to be secured to the support surface.

3. A product display as set forth in claim 2 wherein said hook is generally L-shaped.

4. A product display as set forth in claim 1 wherein said header portion is integral with said strip portion.

5. A product display as set forth in claim 1 wherein said header portion includes a display area adapted to display product indicia.

6. A product display as set forth in claim 1 wherein said header portion includes a pair of side walls, and said side walls and said end walls depend from said top wall.

7. A product display as set forth in claim 6 wherein said strip portion has a longitudinal axis and said header portion is aligned on the longitudinal axis of said strip portion and with said strip portion extending below said header portion.

8. A product display as set forth in claim 1 wherein said guide members are generally U-shaped in cross-section.

9. A product display as set forth in claim 8 wherein said U-shaped guide members are defined by a first wall, a second wall and a web therebetween, and wherein said first wall of each of said guide members including said apertures.

10. A product display as set forth in claim 1 wherein said guide members are generally parallel relative to each other.

11. A product display as set forth in claim 1 wherein said apertures are generally U-shaped.

12. A product display as set forth in claim 1 wherein said strip portion terminates in an end wall defining a stop member extending outwardly from said central wall.

13. A product display as set forth in claim 1 wherein said product hanger is fabricated of a length of shaped wire.

14. A product display as set forth in claim 1 wherein said product hanger includes a loop portion between said hanger ends and wherein said support member includes said loop portion.

15. A product display as set forth in claim 14 wherein said loop portion includes a pair of resilient legs with each of said legs terminating in one of said hanger ends.

16. A product display as set forth in claim 15 wherein said product hanger includes an end portion connecting said resilient legs.

17. A product display as set forth in claim 16 wherein said resilient legs include a first portion and a second portion and wherein said first portion is at an angle relative to said second portion.

18. A product display as set forth in claim 17 wherein said resilient legs include a third portion and wherein said hanger ends extend generally perpendicular from said third portion.

19. A product display as set forth in claim 1 wherein a spacer depends from said central wall.

20. A product display comprising:

a base unit having a header portion and an elongate strip portion, said header portion adapted to be secured to a support surface, said header portion including a top wall, a pair of side walls depending from said top wall and a pair of end walls depending from said top wall, said header portion also including a plurality of gussets depending from said top wall and one of said end walls, said strip portion including a central wall having a pair of side edges and a pair of guide members each having a length, with said members abutting said side edges, wherein said guide members having therein a plurality of apertures along said length; and at least one product hanger having a pair of hanger ends, wherein said hanger ends are removably positionable in said apertures to secure said product hanger to said strip portion, said product hanger includes a support member adapted to support products to be displayed.

* * * * *